US007307532B2

(12) United States Patent
Ikeda et al.

(10) Patent No.: US 7,307,532 B2
(45) Date of Patent: Dec. 11, 2007

(54) MULTIPLE SHEETS FEEDING DETECTION APPARATUS, SORTER, AND METHOD OF DETECTING MULTIPLE SHEETS FEEDING

(75) Inventors: Kenichi Ikeda, Tokyo (JP); Yasuhiko Hasegawa, Tokyo (JP)

(73) Assignee: NEC Corporation (JP)

( * ) Notice: Subject to any disclaimer, the term of this patent is extended or adjusted under 35 U.S.C. 154(b) by 298 days.

(21) Appl. No.: 11/141,397

(22) Filed: Jun. 1, 2005

(65) Prior Publication Data

US 2005/0274791 A1 Dec. 15, 2005

(30) Foreign Application Priority Data

Jun. 14, 2004 (JP) ..... 2004-175117

(51) Int. Cl.
*G08B 13/14* (2006.01)

(52) U.S. Cl. ..... 340/572.1; 340/572.4; 340/539.13

(58) Field of Classification Search ..... 340/572.1, 340/572.4, 573.1, 568.1, 539.1, 539.13, 505, 340/825.69; 235/382, 384, 385, 492; 396/578; 399/8

See application file for complete search history.

(56) References Cited

U.S. PATENT DOCUMENTS 6,106,166 A * 8/2000 Spurr et al. ..... 396/578
6,827,279 B2 * 12/2004 Teraura ..... 235/492
6,992,587 B2 * 1/2006 Maeda et al. ..... 340/572.1
7,072,593 B2 * 7/2006 Negishi ..... 399/8
7,161,487 B1 * 1/2007 Tracey et al. ..... 340/572.1

FOREIGN PATENT DOCUMENTS

| | | |
|---|---|---|
| DE | 695 06 607 T2 | 6/1999 |
| JP | 56-161241 | 12/1981 |
| JP | 56-161242 | 12/1981 |
| JP | 57-11144 | 1/1982 |
| JP | 2001-039533 | 2/2001 |
| JP | 2001-205199 | 7/2001 |
| JP | 2003-237926 | 8/2003 |
| JP | 2003-288628 | 10/2003 |

* cited by examiner

*Primary Examiner*—Van T. Trieu
(74) *Attorney, Agent, or Firm*—Dickstein, Shapiro, LLP.

(57) ABSTRACT

A multiple sheets feeding detection apparatus, sorter, and method of detecting multiple sheets feeding are provided which can ensure reliable detection of multiple sheets feeding without causing any damage to target objects and can increase the processing capability by high-speed detecting operations.

The multiple sheets feeding detection apparatus comprises a passage detector that detects passage of a target object, a management code detector that receives management code information wirelessly sent from an RFID tag of the target object, a controller that determines a carrier state of the target object on the basis of passage information and the management code information, and outputs a multiple feed signal when multiple sheets feeding occurs, and removal portion for removing the target object from carrier portion upon receipt of the multiple feed signal.

11 Claims, 9 Drawing Sheets

MULTIPLE SHEETS FEEDING DETECTION APPARATUS, SORTER, AND METHOD OF DETECTING MULTIPLE SHEETS FEEDING

BACKGROUND OF THE INVENTION

1. Field of the Invention

The present invention relates to a multiple sheets feeding detection apparatus, a sorter, and a method of detecting multiple sheets feeding, and more particularly, to those multiple sheets feeding detection apparatus, sorter, and method of detecting multiple sheets feeding for use to detect feeding of multiple objects which are target subject of detection (referred to simply as a target object, appropriately) and each of which has an RFID (Radio Frequency Identification) tag attached thereto, and to remove target objects involved in multiple sheets feeding.

2. Description of the Prior Art

Conventional multiple sheets feeding detection apparatuses provided in a sorter for paper sheets and the like incorporate a shifting mechanism or a separating mechanism to detect multiple sheets feeding in a condition where those paper sheets are forcibly bent.

As a multiple sheets feeding detection apparatus incorporating the shifting mechanism, disclosed is for example the technology of a double sheet feeding detection apparatus that measures the length of paper sheets before and after they pass through the sifting mechanism and detects double sheet feeding on the basis of the measurement result (see Patent Document 1).

Furthermore, as a multiple sheets feeding detection apparatus incorporating the separating mechanism, disclosed is for example the technology of a double sheet feeding detection apparatus for paper sheets that uses two belts, light emitters, and light receivers to detect double sheet feeding for paper sheets (see Patent Documents 1 and 2).

A conventional sorter (transporter) 100 comprises, as shown in FIGS. 9A and 9B, a guide rail 150 formed into an endless loop, a plurality of carrier boxes 120 that travel along the circular guide rail 150, a feeder 112 that feeds target objects 103 to be sorted, a drop portion 113 that drops the target object 103 into the carrier box 120, and carrier portion 114 for carrying the target object 103 from the feeder 112 to the drop portion 113. This sorter 100 can sort the target object 103 dropped in the carrier box 120 into a predetermined gathering portion 110 (see Patent Document 3).

This sorter 100 is configured so that the bottom cover (not shown) of the carrier box 120 is opened above the predetermined gathering portion 110 and then the dropped target object 103 is dropped from the carrier box 120 into the predetermined gathering portion 110.

When the target object 103 is a paper sheet, the thickness and frictional coefficient of the paper sheet, the surface condition influenced by humidity, or the attraction property of static electricity make two or more paper sheets stick together just like a single sheet of paper. At this time, multiple sheets feeding occurs, and the paper sheet sticking to the underside of another is sorted to a wrong gathering portion 110. That is, paper sheets fed must be carried one by one, and the target object 103 to be sorted has to solely be carried by each carrier box 120.

In order to eliminate this inconvenience, the sorter 100 is provided with the foregoing double sheet feeding detection apparatus for paper sheets (not shown in FIGS. 9A and 9B) in the drop portion 113 or in the vicinity thereof. By using this double sheet feeding detection apparatus of the sorter 100, one paper sheet is dropped always one by one in each carrier box 120.

By the way, recent article sorting devices automatically sort articles by reading information from barcodes or radio frequency ID (identification) tags attached to the outside of those articles. This technique has been studied actively as a product identification and management technology in place of barcodes.

For example, the technology of an article sorting apparatus which uses multiread-based radio frequency ID tags is disclosed. In this technology, a multiread-based radio frequency ID tag is attached to all articles grouped into bundles, and the article sorting apparatus has sorting destination determination portion for comparing sorting information among articles included in one grouped bundle, and determining to sort the articles in the one grouped bundle to the same sorting destination when sorting destinations of those articles in the one grouped bundle are the same (see Patent Document 4).

According to this technology, even in the case of handling a plurality of articles as a bundle, the workability is enhanced because articles are sorted to appropriate sorting chutes.

Furthermore, the technology of a transport system is disclosed, in which transport information is written to radio frequency tags each provided with an IC memory, and the radio frequency tags are attached to transport items so that these transport items are transported in accordance with transport information obtained from their respective radio frequency tags attached (see Patent Document 5).

According to this technology, the transport efficiency of transport items such as parcels can be increased, and tracking and monitoring operations for those transport items can be facilitated.

Moreover, the technology of a distribution system is disclosed, in which distribution centers or retail stores use product information in barcodes or radio frequency tags written by vendors so as thereby to enhance the workability (see Patent Document 6).

According to this technology, the working efficiency of sorting or transshipping products at distribution centers and retail stores, as well as during transportation, can be improved.

Moreover, the technology of a paper sheet determination apparatus is disclosed which determines the number of paper sheets by use of a thickness sensor (see Patent Document 7).

According to this technology, even when paper sheets are overlapping or skewed and paper sheets having folded, torn, or cut portions are carried, the number or type of sheets can accurately be determined.

(Patent Document 1) Japanese Utility Model Laid-Open No. 57-011144 (claim 1, FIG. 1)

(Patent Document 2) Japanese Patent Laid-Open No. 56-161241 (claim 1, FIGS. 1 and 4)

(Patent Document 3) Japanese Patent Laid-Open No. 56-161242 (claim 1, FIGS. 1 and 4)

(Patent Document 4) Japanese Patent Laid-Open No. 2003-237926 (FIG. 7)

(Patent Document 5) Japanese Patent Laid-Open No. 2001-39533 (claim 1)

(Patent Document 6) Japanese Patent Laid-Open No. 2001-205199 (claim 1)

(Patent Document 7) Japanese Patent Laid-Open No. 2003-288628 (claim 1)

The above described sorter 100, however, cannot raise the processing capability thereof because of a bottleneck in the conventional double sheet feeding detection apparatus (see Patent Documents 2 and 3) that detects double sheet feeding in a condition where paper sheets are forcibly bent and separated from each other.

Specifically, for greater processing capability of the sorter 100, the sheet handling speed has to be increased. However, high-speed operations of the above double sheet feeding detection apparatus may cause folds or any other damages to paper sheets, so that this apparatus is disadvantageously not allowed to handle paper sheets at high speed.

Another double sheet feeding detection apparatus (see Patent Document 1) detects multiple sheets feeding by separating paper sheets through the physical shifting operation, which also causes folds or any other damages to paper sheets when this apparatus is operated at high speed. Therefore, this apparatus is not allowed to handle paper sheets at high speed.

Furthermore, the above two types of double sheet feeding detection apparatuses are not able to separate or shift paper sheets strongly sticking together due to static electricity or other causes, even when applying the separating or shifting operations to these sticking paper sheets. Therefore, erroneous detection may occur disadvantageously.

Moreover, the above two types of double sheet feeding detection apparatuses apply external loads to detection target objects, and thus cannot detect unbendable objects or objects having soft surfaces. Therefore, a limitation is imposed on the types of target objects.

BRIEF SUMMARY OF THE INVENTION

In order to solve the foregoing problems, the present invention has an object to provide a multiple sheets feeding detection apparatus, a sorter, and a method of detecting multiple sheets feeding, all of which can ensure reliable detection of multiple sheets feeding without causing any damage to target objects and can increase the processing capability by high-speed detecting operations.

In order to achieve the above object, a multiple sheets feeding detection apparatus according to the present invention comprises: a passage detector that detects passage of a target object and outputs passage information, the target object being carried by carrier means and having an RFID tag attached thereto; a management code detector that receives management code information wirelessly sent from the RFID tag, and outputs the management code information; and a controller that receives the passage information and the management code information, determines a carrier state of the target object in accordance with the passage information and the management code information, and outputs a multiple feed signal when multiple sheets feeding occurs.

With this configuration, the multiple sheets feeding detection apparatus does not cause any damage to target objects because no physical load is applied thereto, and ensures detection of multiple sheets feeding even when target objects are strongly sticking together. Furthermore, this multiple sheets feeding detection apparatus is allowed to perform high-speed detecting operation because it does not forcibly bend target objects, which leads to an increase in the processing capability.

The multiple sheets feeding detection apparatus of the present invention further comprises removal means for removing the target object from the carrier means upon receipt of the multiple feed signal.

By thus removing a target object involved in multiple sheets feeding, problems to multiple sheets feeding, such as erroneous sorting, can be prevented.

According to the multiple sheets feeding detection apparatus of the present invention, the target object is a paper sheet.

With this configuration, multiple sheets feeding of paper sheets susceptible thereto can be detected effectively.

Note here that the paper sheet includes a postcard, envelope, paper, bill, voucher, card, and the like.

According to the multiple sheets feeding detection apparatus of the present invention, the RFID tag is attached indirectly to the target object.

With this configuration, the multiple sheets feeding detection apparatus can detect multiple sheets feeding even when the RFID tag is not attached directly to the target object.

The indirect attachment of the RFID tag to the target object means to attach the RFID tag to a case for housing the target object, or to a mailing label or transaction slip placed on the target object.

According to the multiple sheets feeding detection apparatus of the present invention, the controller sends and writes predetermined information corresponding to the carrier state of the target object to the RFID tag via the management code detector.

With this configuration, historical records of each target object, such as information indicating passing multiple feed inspection, can be written to the RFID tag of each target object, which leads to an increase in the management level of target objects.

In order to achieve the foregoing object, a sorter for sorting target objects according to the present invention comprises: a feeder that feeds the target objects; a drop unit that drops the target objects; carrier means for carrying the target objects from the feeder to the drop unit; and the previously mentioned multiple sheets feeding detection apparatus provided along the carrier means.

With this configuration, the target objects are not forcibly bent, which allows high-speed detection of multiple sheets feeding, thereby increasing the processing capability.

Furthermore, in order to achieve the foregoing object, a method of detecting multiple sheets feeding according to the present invention comprises: a passage detecting step of detecting passage of a target object and outputting passage information, the target object being carried by carrier means and having an RFID tag attached thereto; a management code detecting step of receiving management code information wirelessly sent from the RFID tag and outputting the management code information; a controlling step of receiving the passage information and the management code information, determining a carrier state of the target object in accordance with the passage information and the management code information, and outputting a multiple feed signal when multiple sheets feeding occurs.

With this configuration, the method of detecting multiple sheets feeding does not cause any damage to target objects because no physical load is applied thereto, and ensures detection of multiple sheets feeding even when target objects are strongly sticking together. Furthermore, this method allows high-speed detection because target objects are not forcibly bent, which leads to an increase in the processing capability.

This method of detecting multiple sheets feeding of the present invention further comprises a removing step of removing the target object from the carrier means upon receipt of the multiple feed signal.

By thus removing a target object involved in the multiple sheets feeding, problems ascribable to multiple sheets feeding, such as erroneous sorting, can be prevented.

According to the method of detecting multiple sheets feeding, the target object is a paper sheet.

With this configuration, multiple sheets feeding of paper sheets susceptible thereto can be detected effectively.

Note here that the paper sheet includes a postcard, envelope, paper, bill, voucher, card, and the like.

According to the method of detecting multiple sheets feeding of the present invention, the RFID tag is attached indirectly to the target object.

With this configuration, this method allows detection of multiple sheets feeding even when the RFID tag is not attached directly to the target object.

The indirect attachment of the RFID tag to the target object means to attach the RFID tag to a case for housing the target object, or to a mailing label or transaction slip placed on the target object.

According to the method of detecting multiple sheets feeding of the present invention, the controlling step includes sending and writing predetermined information corresponding to the carrier state of the target object to the RFID tag through the management code detecting step.

With this configuration, historical records of each target object, such as information indicating passing multiple feed inspection, can be written to the RFID tag of each target object, which leads to an increase in the management level of target objects.

The multiple sheets feeding detection apparatus of the present invention ensures detection of multiple sheets feeding even when target objects are strongly sticking together due to static electricity or other causes. Furthermore, multiple sheets feeding of target objects can be detected even when they are inflexible metal sheets or unbendable ceramic sheets. Therefore, a wider range of target objects can be handled by this apparatus.

Furthermore, the multiple sheets feeding detection apparatus does not forcibly bend target objects, so that problems such as causing damages to target objects can be prevented.

Moreover, the multiple sheets feeding detection apparatus is capable of high-speed detecting operations, thereby increasing the processing capability.

The sorter of the present invention can also increase the processing capability by virtue of the high-speed detecting operations of the multiple sheets feeding detection apparatus. This sorter ensures reliable and secure detection of multiple sheets feeding of target objects, and is able to detect multiple sheets feeding of target objects which is not detectable by the conventional multiple sheets feeding detection apparatus. Therefore, a wider range of target objects can be handled by this sorter.

The method of detecting multiple sheets feeding of the present invention ensures detection of multiple sheets feeding of target objects even when they are strongly sticking together due to static electricity or other causes. Furthermore, even when target objects are inflexible metal sheets or unbendable ceramic sheets, multiple sheets feeding can be detected, so that a wider range of target objects can be handled.

Moreover, since target objects are not forcibly bent in this method of detecting multiple sheets feeding, problems such as causing damages to target objects can be prevented.

Furthermore, this method of detecting multiple sheets feeding allows high-speed detecting operations, which leads to an increase in the processing capability.

DETAILED DESCRIPTION OF THE PREFERRED EMBODIMENTS (Multiple Sheets Feeding Detection Apparatus)

Figure 1:
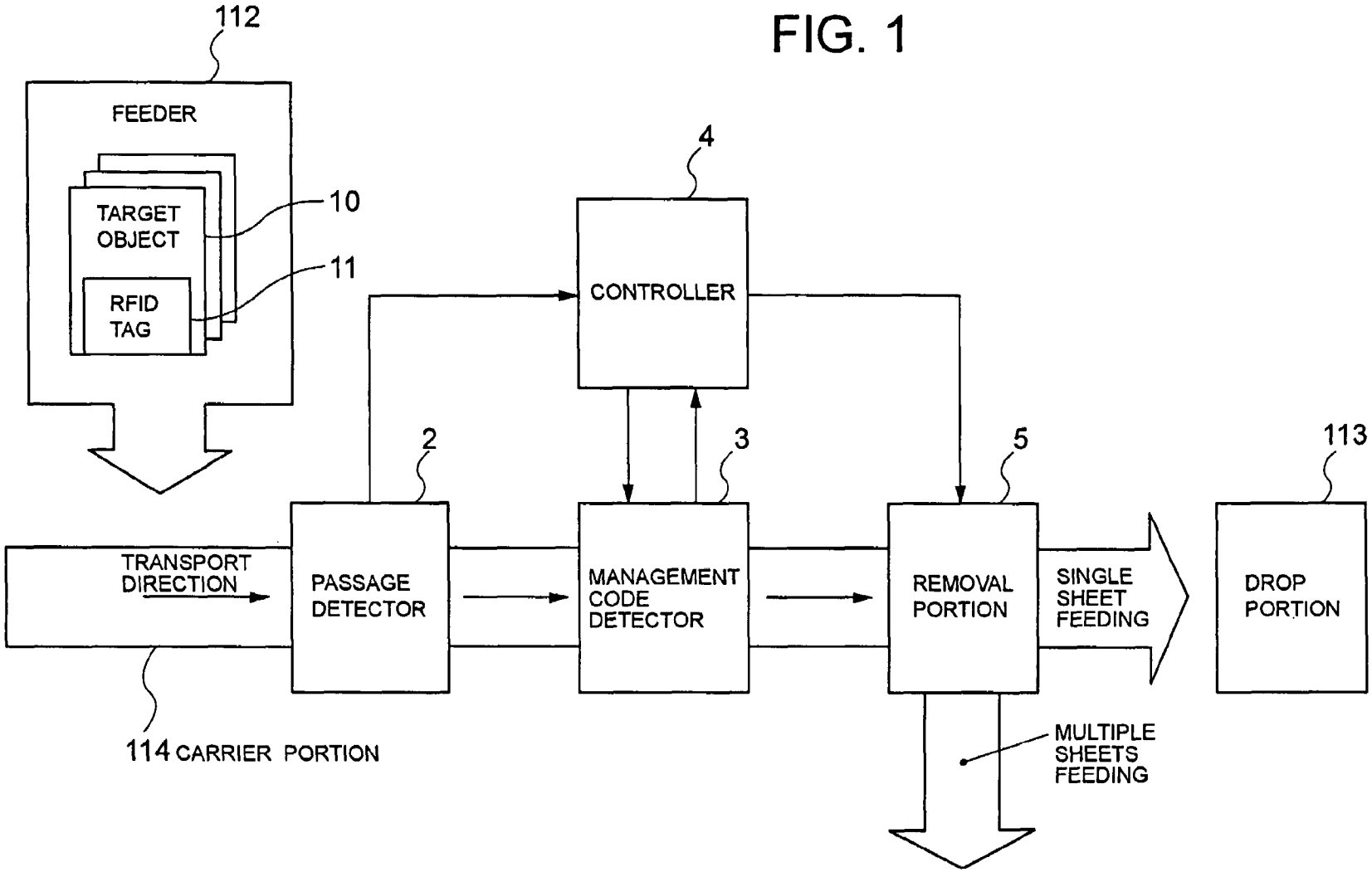
FIG. 1 is a schematic block diagram for explaining a basic configuration of a multiple sheets feeding detection apparatus according to an embodiment of the present invention.

FIG. 1 is a schematic block diagram for explaining a basic configuration of a multiple sheets feeding detection apparatus according to a preferred embodiment of the present invention.

Referring to this drawing, a multiple sheets feeding detection apparatus 1 comprises a passage detector 2 that detects passage of a target object 10 and outputs passage information, a management code detector 3 that receives management code information wirelessly sent from an RFID tag 11 attached to the target object 10 and outputs the management code information, and a controller 4 that receives the passage information from the passage detector 2 and also receives the management code information from the management code detector 3, determines a carrier state of the target object 10 on the basis of the passage information and the management code information, and outputs a multiple feed signal when multiple sheets feeding occurs. The multiple sheets feeding detection apparatus 1 according to this embodiment further comprises removal portion 5 for removing the target object 10 from carrier portion 114 upon receipt of the multiple feed signal.

The carrier portion 114 is linked with a feeder 112 and a drop portion 113 so as thereby to carry the target object 10 one by one from the feeder 112 to the drop portion 113 in the normal operation state.

(Target Object)

The target object 10 is a paper sheet to which is directly attached an RFID tag 11. This RFID tag 11 is a minute IC chip having recorded therein the management code information and the like, and is capable of transmitting and receiving information via wireless communication. Furthermore, the RFID tag 11 in this embodiment sends stored information upon receipt of a transmission start signal.

In this embodiment, the target objects 10 are paper sheets. With this configuration, multiple sheets feeding of paper sheets susceptible thereto can be detected effectively.

It should be noted here that the target objects 10 are not limited to paper sheets and may be any other objects of which multiple sheets feeding has to be detected.

The RFID tag 11 is attached directly to the target object 10, but is not limited to this case. For example, this RFID tag 11 may alternatively be attached indirectly to the target object 10. This indirect attachment of the RFID tag 11 allows the multiple sheets feeding detection apparatus 1 to detect multiple sheets feeding of target objects 10 to which the RFID tag 11 is not attachable directly.

(Passage Detector)

Figure 2:
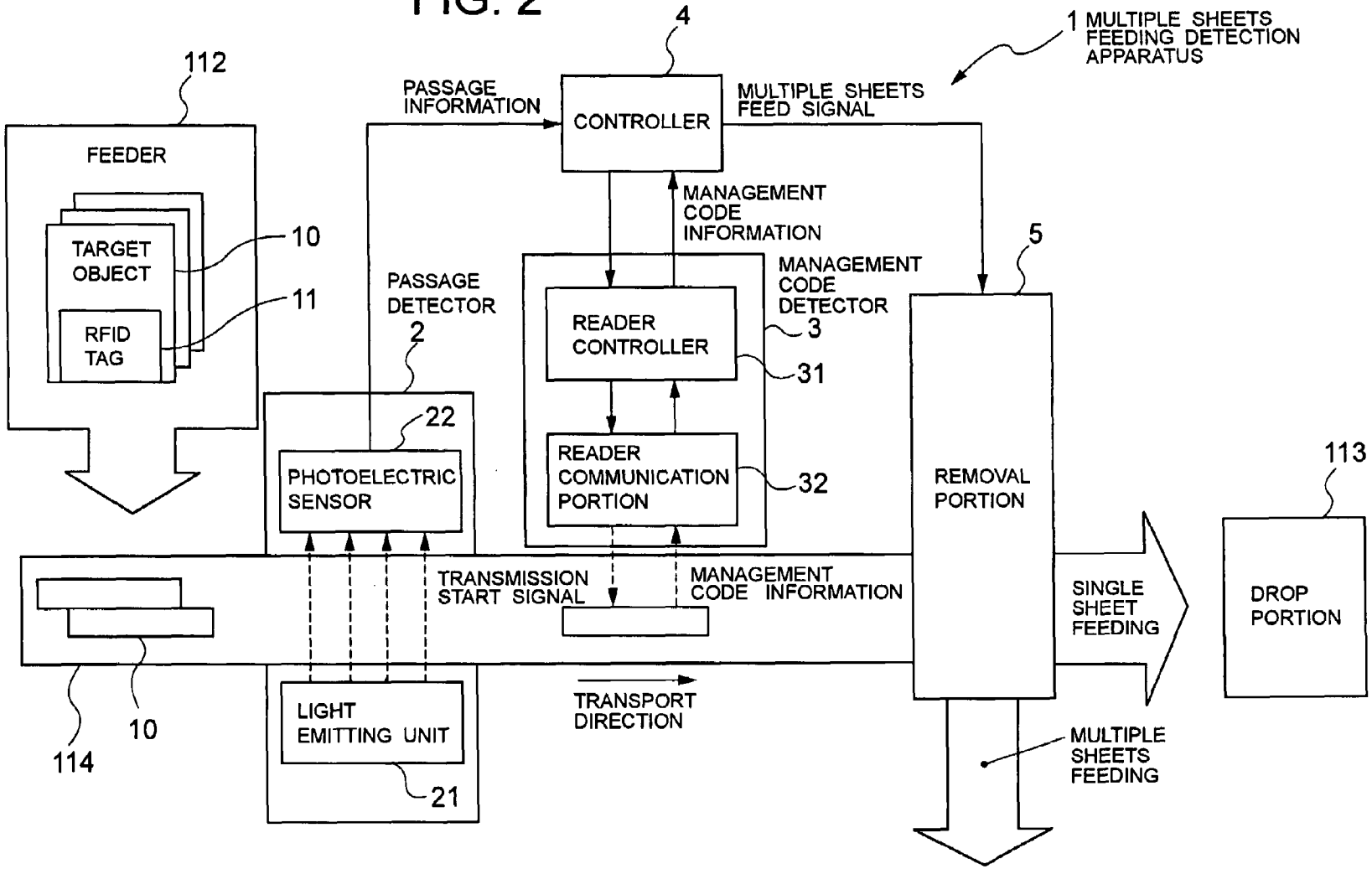
FIG. 2 is a schematic block diagram for explaining a detailed configuration of the multiple sheets feeding detection apparatus according to the embodiment of the present invention.

FIG. 2 is a schematic block diagram for explaining a detailed configuration of the multiple sheets feeding detection apparatus according to the embodiment of the present invention.

Referring to this drawing, the passage detector 2 has a light emitting unit 21 and a photoelectric sensor 22. The passage detector 2 output to the controller 4, passage information as to whether the photoelectric sensor 22 senses light from the light emitting unit 21.

The passage detector 2, the management code detector 3, and the removal portion 5 are disposed in that order along the carrier portion 114 from upstream to downstream thereof.

Note here that the passage detector 2 is not limited to the configuration having the photoelectric sensor 22, as long as the passage detector 2 is so configured as to sense the passage of the target object 10.

(Controller)

The controller 4 has an information processing feature, and a computer or sequencer is generally used as this controller 4.

The controller 4 receives the passage information from the passage detector 2, and outputs a transmission start signal to the management code detector 3 when the photoelectric sensor 22 no longer detects light from the light emitting unit 21 (at the time when the target object 10 starts passing). The controller 4 also receives the management code information corresponding to the transmission start signal, and determines whether the number of pieces of the management code information received before the expiration of determination time is one or greater. When two or more pieces of the management code information are received, the controller 4 determines that multiple sheets feeding occurs, and thus outputs a multiple feed signal to the removal portion 5.

(Management Code Detector)

The management code detector 3 has a reader controller 31 and a reader communication portion 32 which are operable to read the management code information of the RFID tag 11.

When the reader controller 31 receives the transmission start signal from the controller 4, the management code detector 3 controls the reader communication portion 32 to send the transmission start signal to the currently passing RFID tag 11 via wireless communication. Also, when the reader communication portion 32 receives the management code information from the RFID tag 11 via wireless communication, the management code detector 3 controls the reader controller 31 to receive this management code information and output this management code information to the controller 4.

Note here that the management code detector 3 is not limited to the above configuration, and another alternative configuration is allowable in which, for example, the reader controller 31 is not provided and the reader communication portion 32 is controlled by the controller 4.

(Removal Portion)

The removal portion 5 has a compressed air supply unit and a solenoid valve for controlling ON and OFF states of this supply unit, both of which are not shown. When the solenoid vale receives the multiple feed signal, the removal portion 5 is brought into an ON state for a predetermined time during which the compressed air is blown from the supply unit to the target objects 10 involved in multiple sheets feeding, thereby to remove them from the carrier portion 114. By thus removing the target objects 10 involved in multiple sheets feeding, problems ascribable to multiple sheets feeding, such as erroneous sorting, can be prevented.

Note here that the removal portion 5 is not limited to the above configuration, and another alternative configuration is allowable in which, for example, an air cylinder pushes the target objects 10 out from the carrier portion 114.

Next, a description will be given of operations of the multiple sheets feeding detection apparatus 1 with reference to the drawings.

Figure 3:
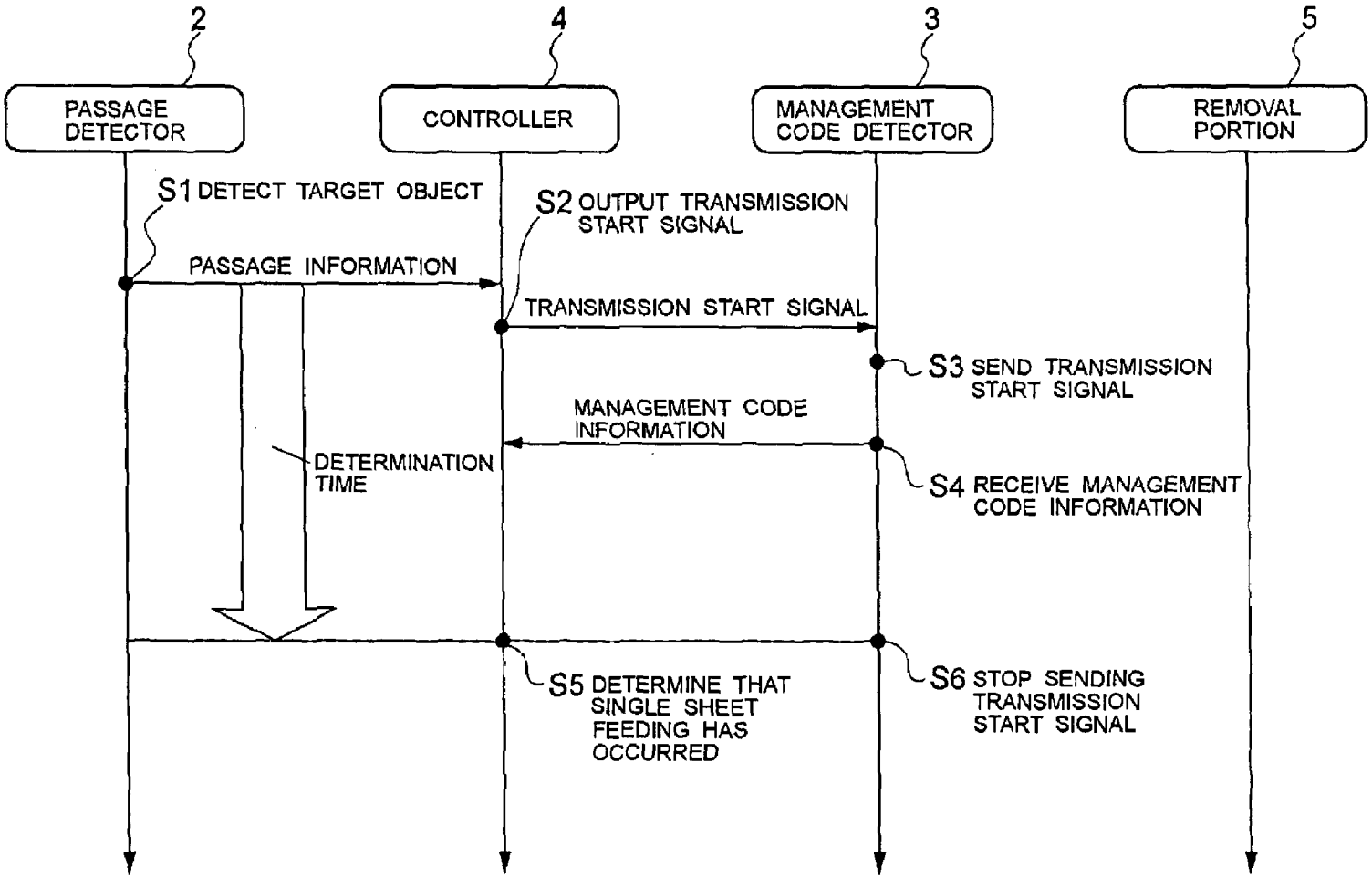
FIG. 3 is a schematic time chart for explaining exemplary operations performed when the multiple sheets feeding detection apparatus according to the embodiment of the present invention detects single sheet feeding.

FIG. 3 is a schematic time chart for explaining exemplary operations performed when the multiple sheets feeding detection apparatus according to the embodiment of the present invention detects single sheet feeding.

Referring to this drawing, the passage detector 2 outputs passage information to the controller 4 upon detection of the target object 10 (step S1).

Upon receipt of the passage information, the controller 4 outputs a transmission start signal to the management code detector 3 (step S2). The controller 4 counts down the determination time for determining whether multiple sheets feeding occurs or not since the receipt of the passage information, and determines at the expiration of this determination time whether the multiple sheets feeding has occurred.

This determination time is generally set to a period of time since the controller 4 has received the passage information until the upstream end of the target object 10 in transportation (the end of the feeder 112 side) passes the reader communication portion 32.

Subsequently, when the reader controller 31 of the management code detector 3 receives the transmission start signal, the management code detector 3 controls the reader communication portion 32 to send the transmission start signal via wireless communication (step S3). Then, the RFID tag 11 of the target object 10 (not shown) receives this transmission start signal, and thereafter sends the management code information stored therein via wireless communication.

Next, the reader communication portion 32 of the management code detector 3 receives the management code information from the RFID tag 11 (step S4). The reader controller 31 then receives input of this management code information from the reader communication portion 32, and then outputs it to the controller 4.

The management code detector 3 continues sending the transmission start signal until the expiration of the above described determination time. Therefore, even when target objects 10 involved in multiple sheets feeding are sliding over one another in the transport direction, the management code detector 3 can receive the management code information also from the RFID tags 11 of target objects 10 that are carried behind others.

Next, the controller 4 counts the number of pieces of received management code information at the expiration of the determination time. In this example, the controller 4 receives one piece of the management code information, and thus determines that single sheet feeding has occurred (multiple sheets feeding has not occurred) (step S5). The management code detector 3 stops sending the transmission start signal at the expiration of the determination time.

The multiple sheets feeding detection apparatus 1 then completes a cycle of detecting operations.

Figure 4:
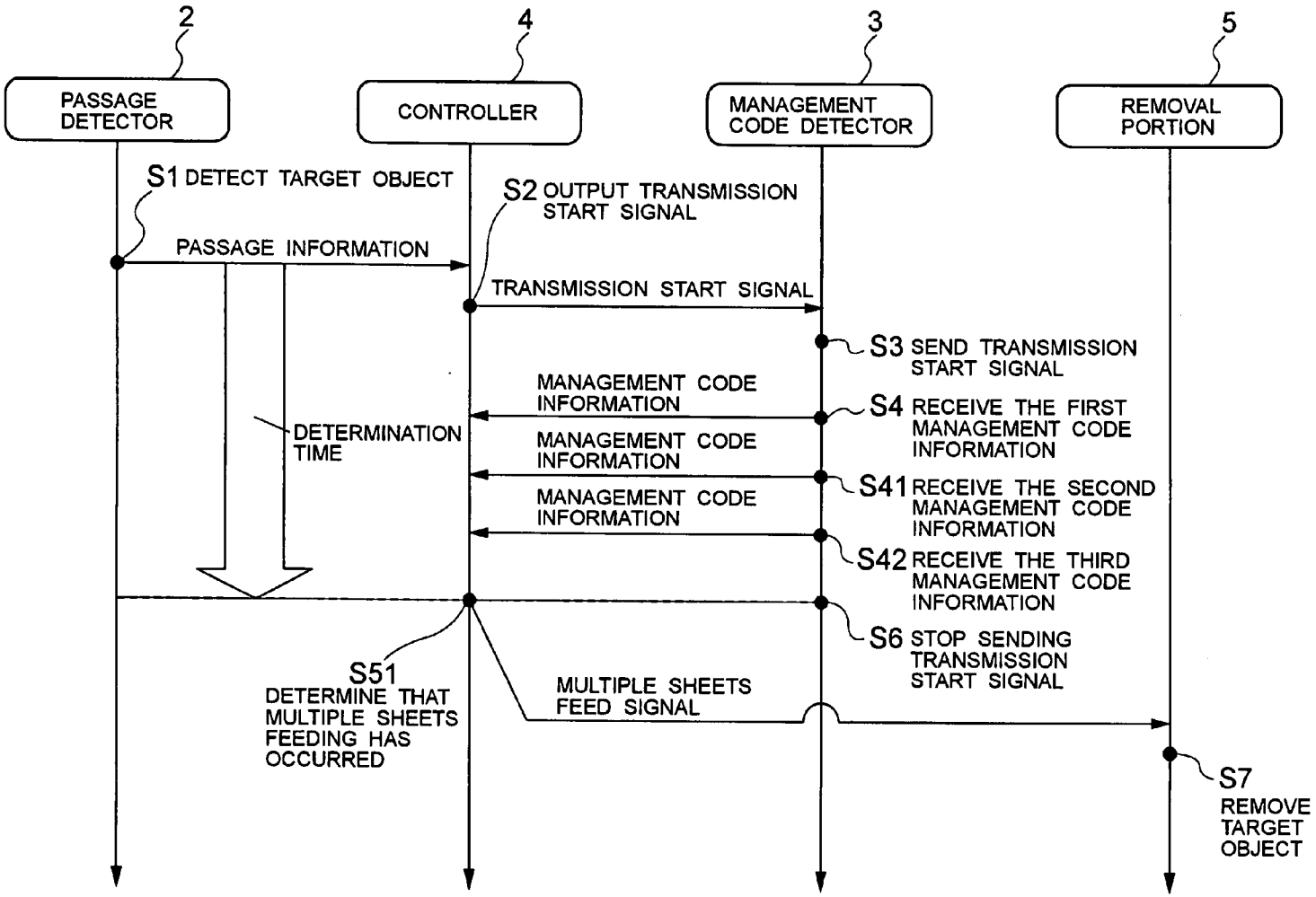
FIG. 4 is a schematic time chart for explaining exemplary operations performed when the multiple sheets feeding detection apparatus according to the embodiment of the present invention detects multiple sheets feeding.

FIG. 4 is a schematic time chart for explaining exemplary operations performed when the multiple sheets feeding detection apparatus according to the embodiment of the present invention detects multiple sheets feeding.

The operations of the multiple sheets feeding detection apparatus 1 shown in FIG. 4 are different from the foregoing exemplary operations in that three target objects 10 are involved in multiple sheets feeding while they are sliding over one another in the transport direction. Other operations (steps S1, S2, S3, S4, and S6) are almost the same as the foregoing exemplary operations.

Accordingly in FIG. 4, these same operations are designated with the same reference characters and numerals as in FIG. 3, and the descriptions therefor will be omitted.

In the example of FIG. 4, since the target objects 10 are involved in multiple sheets feeding, the management code detector 3 receives the first management code information in step S4, and then receives the second and subsequently the third management code information (steps S41 and S42). The management code detector 3 then outputs these received management code information to the controller 4.

Next, the controller 4 counts the number of pieces of received management code information at the expiration of the determination time. In this example, the controller 4 receives three pieces of the management code information, therefore determines that multiple sheets feeding has occurred (step S51), and then outputs a multiple feed signal to the removal portion 5.

Upon receipt of the multiple feed signal, the removal portion 5 blows compressed air to the carried target objects 10 involved in multiple sheets feeding, thereby to remove these target objects 10 from the carrier portion 114 (step S7).

The multiple sheets feeding detection apparatus 1 then completes a cycle of detecting operations.

Figure 5:
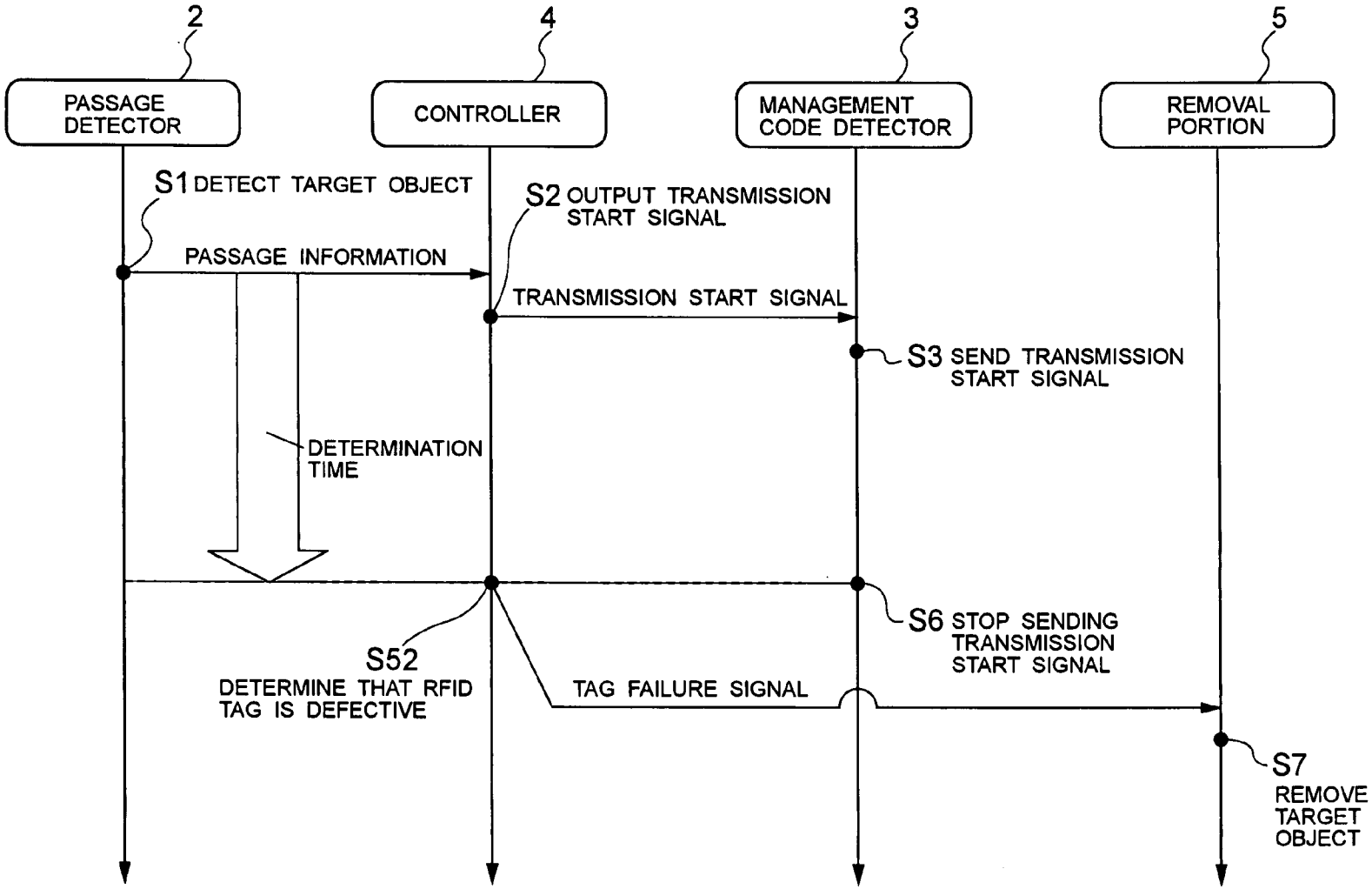
FIG. 5 is a schematic time chart for explaining exemplary operations performed when the multiple sheets feeding detection apparatus according to the embodiment of the present invention detects failure in an RFID tag.

FIG. 5 is a schematic time chart for explaining exemplary operations performed when the multiple sheets feeding detection apparatus according to the embodiment of the present invention detects failure in the RFID tag.

The operations of the multiple sheets feeding detection apparatus 1 shown in FIG. 5 are different from the exemplary operations in FIG. 3 in that the RFID tag 11 of the target object 10 is defective and thus cannot send the management code information stored therein via wireless communication. Other operations (step S1, S2, S3, and S6) are almost the same as the foregoing exemplary operations.

Accordingly in FIG. 5, these same operations are designated with the same reference characters and numerals as in FIG. 3, and the descriptions therefor will be omitted.

In this example, the defective RFID tag 11 of the target object 10 is defective and thus cannot send the management code information stored therein via wireless communication, in response to the transmission start signal coming from the management code detector 3.

The controller 4 counts the number of pieces of received management code information at the expiration of the determination time, but in this example does not receive any management code information. Therefore, the controller 4 determines that the RFID tag 11 of the target object 10 is defective (step S52), and then output a tag failure signal to the removal portion 5.

Upon receipt of the tag failure signal, the removal portion 5 blows compressed air to the carried target object 10 having the defective RFID tag 11 attached thereto, thereby to remove this target object 10 from the carrier portion 114 (step S7).

Then, the multiple sheets feeding detection apparatus 1 completes a cycle of detecting operations.

As described above, by utilizing the RFID tag 11 attached to the target object 10, the multiple sheets feeding detection apparatus 1 according to this embodiment can detect whether multiple sheets feeding occurs or not, without applying physical loads onto the target object 10.

Accordingly, the multiple sheets feeding detection apparatus 1 does not apply physical loads onto the target object 10, and is therefore allowed to perform high-speed detecting operations, so that the processing capability can be greatly enhanced.

Furthermore, the multiple sheets feeding detection apparatus 1 can detect multiple sheets feeding of a wider range of detection target objects 10, such as those being unbendable or having soft surfaces.

Moreover, the multiple sheets feeding detection apparatus 1 does not apply physical loads onto the target object 10, thereby preventing troubles such as causing damages to the target object 10.

Furthermore, the multiple sheets feeding detection apparatus 1 can detect multiple sheets feeding of target objects 10 which are not detectable by the conventional multiple sheets feeding detection apparatus, for example, target objects 10 that are strongly sticking together due to static electricity and cannot be shifted or separated from each other even when physical load is applied thereto.

(Applications)

The multiple sheets feeding detection apparatus 1 of the present invention is not limited to the foregoing configuration, and has a variety of applications.

Next, a description will be given of applications of the multiple sheets feeding detection apparatus 1 with reference to the drawing.

Figure 6:
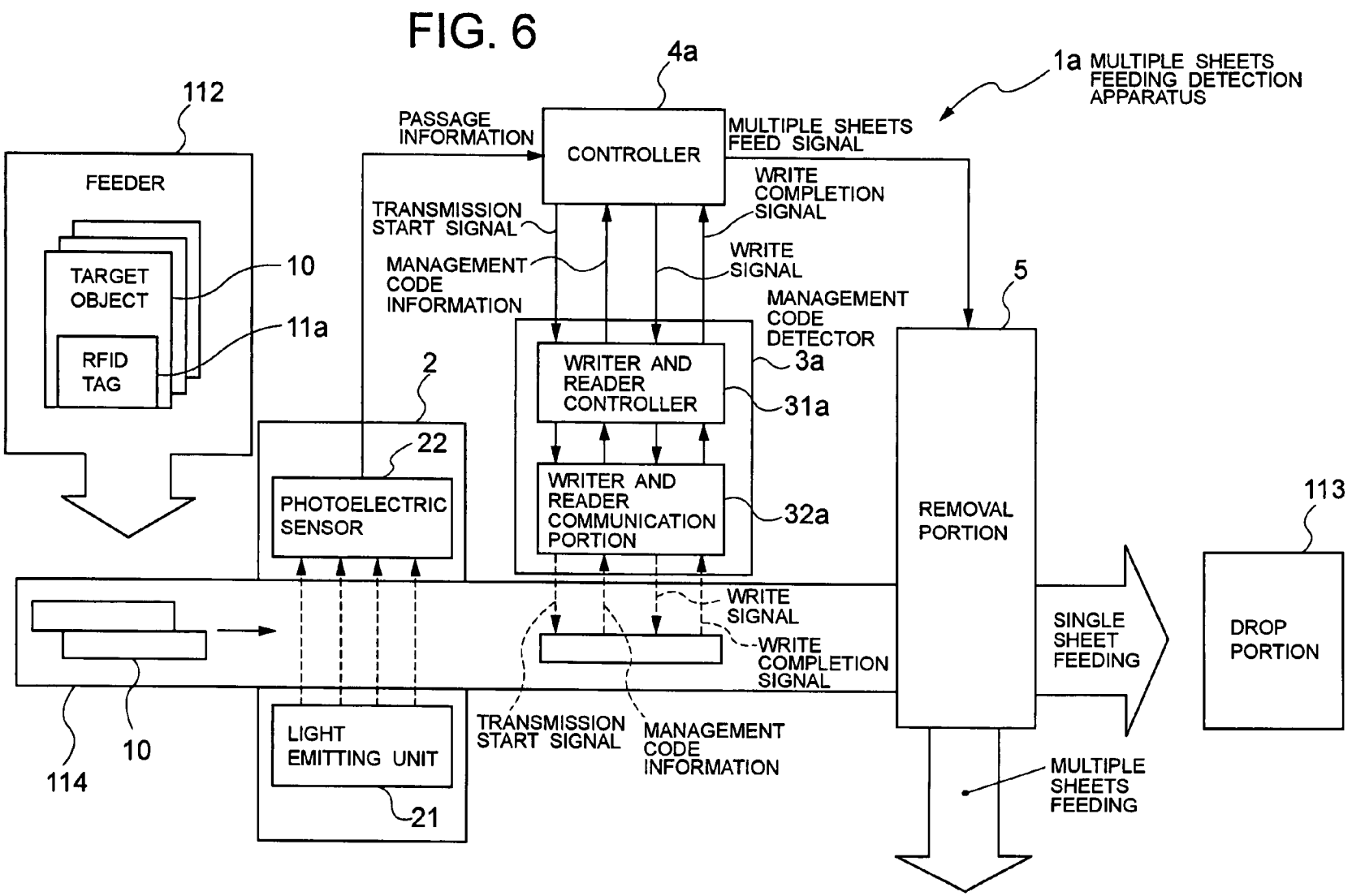
FIG. 6 is a schematic block diagram for explaining a detailed configuration in an application of the multiple sheets feeding detection apparatus according to the embodiment of the present invention.

FIG. 6 is a schematic block diagram for explaining a detailed configuration in one of applications of the multiple sheets feeding detection apparatus according to the embodiment of the present invention.

In this drawing, a multiple sheets feeding detection apparatus 1*a* is different from the multiple sheets feeding detection apparatus 1 of FIG. 2 in that an RFID tag 11*a* attached to the target object 10 has a write-in function in addition to a readout function, and also in that a management code detector 3*a* has a writer and reader controller 31*a* and a writer and reader communication portion 32*a*. Other configurations are almost the same as those in the foregoing multiple sheets feeding detection apparatus 1.

Accordingly in FIG. 6, these same components are designated with the same reference characters and numerals as in FIG. 2, and the descriptions therefor will be omitted.

In this application, when the RFID tag 11*a* attached to the target object 10 receives a write signal, the RFID tag 11*a* stores write information contained in the received write signal. Upon completion of the above-mentioned write operation, the RFID tag 11*a* sends a write completion signal via wireless communication.

The write information includes, for example, information indicating that single sheet feeding of the target object 10 occurred, information of the date and time on which determination of the single sheet feeding was made, and the like, but is not limited thereto.

A controller 4*a* receives from an information system server (not shown), a write signal to the RFID tag 11*a*, and then outputs this write signal to the management code detector 3*a*. This allows a user to freely designate information he/she wants to write into the RFID tag 11*a* via the information system server.

In this application, since the write information includes the information indicating that single sheet feeding of the target object 10 has occurred, the controller 4*a* determines that the single sheet feeding has occurred, and thereafter outputs the write signal to the management code detector 3*a*.

The controller 4*a* also receives a write completion signal from the management code detector 3*a*, and then outputs it to the information system server.

Upon receipt of the write signal from the controller 4*a*, the writer and reader controller 31*a* controls the writer and reader communication portion 32*a* to send the write signal via wireless communication. The writer and reader controller 31*a* also receives a write completion signal received by the writer and reader communication portion 32*a*, and outputs this received write completion signal to the controller 4*a*.

The following paragraphs will describe operations of the multiple sheets feeding detection apparatus 1*a* having the above configuration with reference to the drawing.

Figure 7:
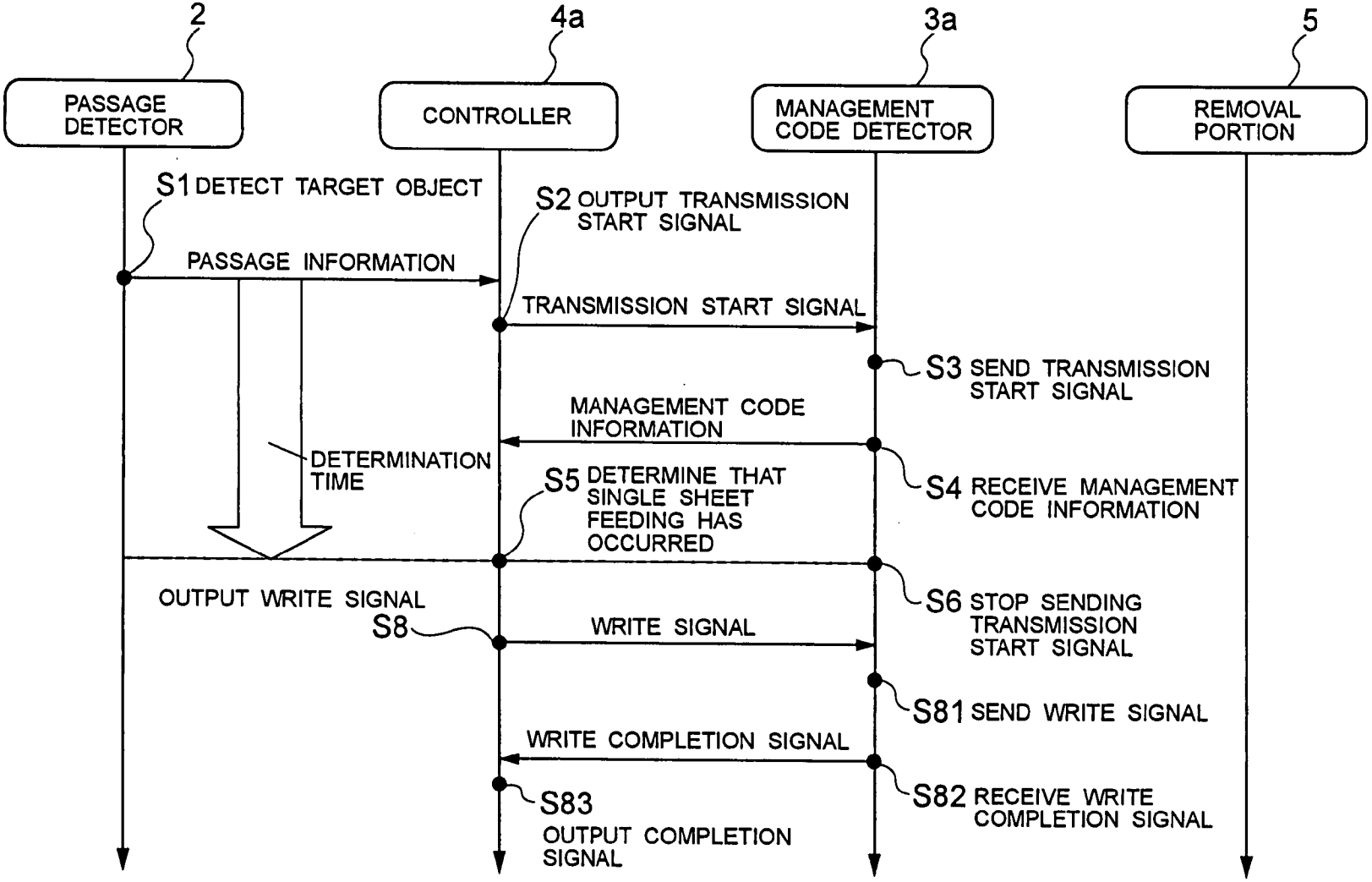
FIG. 7 is a schematic time chart for explaining exemplary operations performed in the application of the multiple sheets feeding detection apparatus according to the embodiment of the present invention when this apparatus detects single sheet feeding.

FIG. 7 is a schematic time chart for explaining exemplary operations in the application of the multiple sheets feeding detection apparatus according to the embodiment of the present invention when this apparatus detects single sheet feeding.

The operations of the multiple sheets feeding detection apparatus 1*a* shown in FIG. 7 are different from the exemplary operations in FIG. 3 in that write information is written to the RFID tag 11*a* of the target object 10 after determination of single sheet feeding is made.

Other operations (steps S1, S2, S3, S4, S5, and S6) are almost the same as the foregoing exemplary operations of FIG. 3.

Accordingly in FIG. 7, these same operations are designated with the same reference characters and numerals as in FIG. 3, and the descriptions therefor will be omitted.

The controller 4*a* which has determined the single sheet feeding of the target object 10 outputs to the management code detector 3*a*, a write signal for the RFID tag 11*a* that is received from the information system server (not shown) (step S8).

When the management code detector 3*a* receives this write signal, the writer and reader communication portion 32*a* of the management code detector 3*a* sends this write signal via wireless communication (step S81). Subsequently, the RFID tag 11*a* of the target object 10, which is not shown, receives the write signal, records write information contained in this write signal, and then sends via wireless communication a write completion signal that contains information indicating the completion of writing.

Next, the management code detector 3*a* receives the write completion signal (step S82), and outputs the received write completion signal to the controller 4*a*.

Upon receipt of the write completion signal, the controller 4*a* outputs a completion signal to the information system server (step S83). This completion signal includes management code information, information indicating that single sheet feeding of the target object 10 occurred, information of the date and time on which determination of the single sheet feeding was made, information indicating the completion of writing to the RFID tag 11*a*, and the like. This allows the information system server to obtain historical data of each target object 10 regarding detection of multiple sheets feeding.

Then, the multiple sheets feeding detection apparatus 1*a* completes a cycle of detecting operations.

As described above, the multiple sheets feeding detection apparatus 1*a* in this application can write, to the RFID tag 11*a* of the target object 10 for which single sheet feeding has been carried out, information indicating the single sheet feeding of the target object 10. Furthermore, historical data of multiple sheets feeding inspection is recorded in the RFID tag 11*a*, so that the management level of target objects 10 is increased.

Note here that the information written to the RFID tag 11*a* is not limited to the above information, and can be various types of information which are freely selectable.

(Sorter)

The present invention is effective also as a sorter which is provided with the foregoing multiple sheets feeding detection apparatus 1 or 1*a*.

A description will be given of this sorter with reference to the drawings.

Figure 8A:
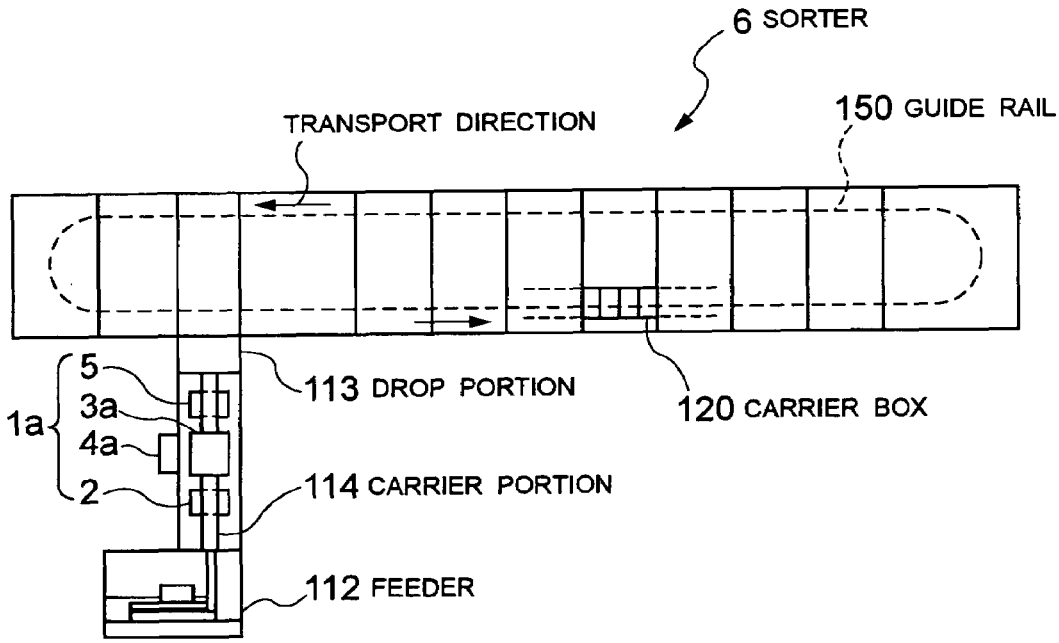
FIGS. 8A and 8B schematically show a plan view and a front view, respectively, of a sorter according to the embodiment of the present invention.
Figure 8B:
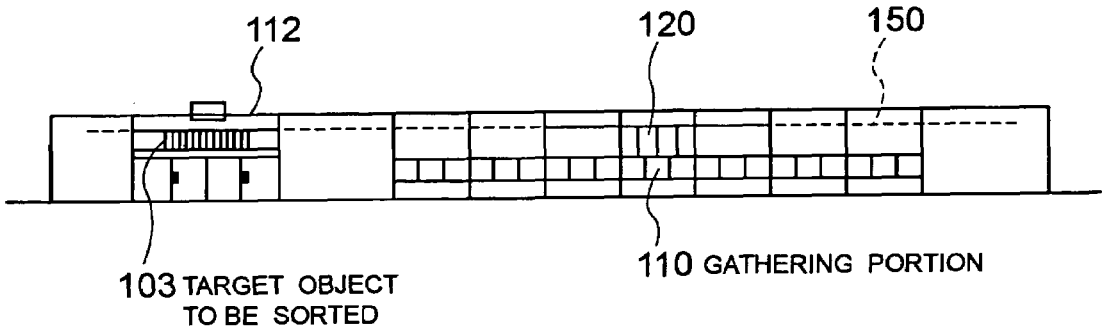

FIGS. 8A and 8B are schematic views of a sorter according to the embodiment of the present invention, and show a plan view and a front view, respectively, of this sorter.

Referring to FIGS. 8A and 8B, a sorter 6 is different from the conventional sorter 100 in that the foregoing multiple sheets feeding detection apparatus 1*a* is provided along the carrier portion 114. Other components are almost the same as those in the conventional sorter 100.

Figure 9A:
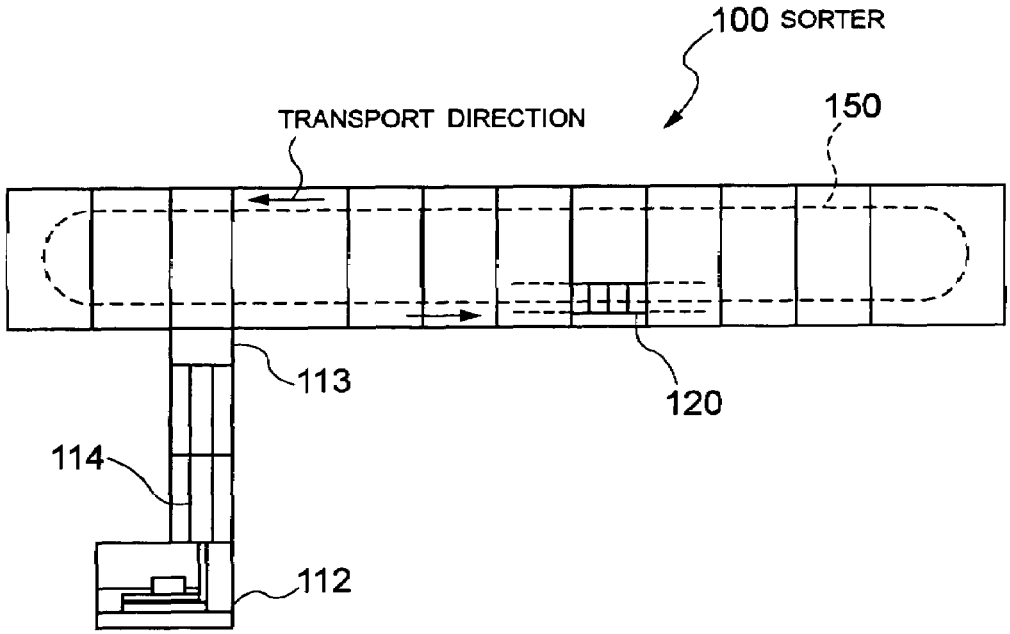
PRIOR ART FIG. 9A
FIGS. 9A and 9B schematically show a plan view and a front view, respectively, of a conventional sorter.
Figure 9B:
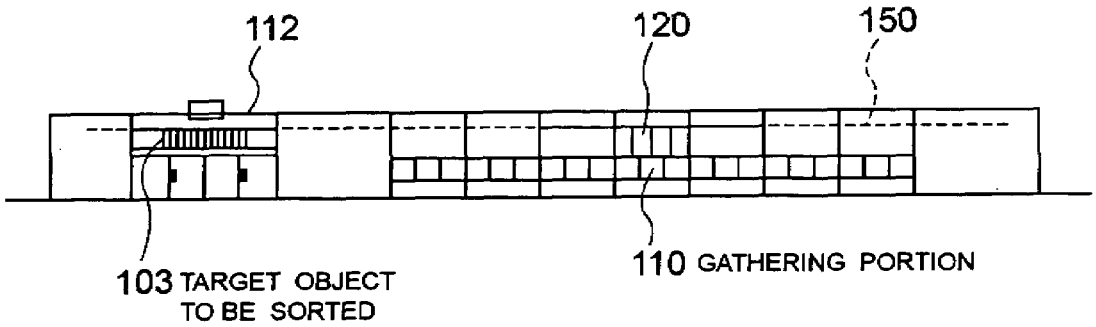

Accordingly in FIGS. 8A and 8B, these same components are designated with the same reference numerals as in FIGS. 9A and 9B, so the descriptions therefor will be omitted.

The sorter 6 is configured so that the passage detector 2, the management code detector 3*a*, and the removal portion 5 are arranged in that order along the carrier portion 114 from upstream to downstream thereof. The controller 4*a* is disposed near the management code detector 3*a*.

The sorter 6 thus configured can increase the processing capability because the multiple sheets feeding detection apparatus 1*a* can perform high-speed operations for detecting multiple sheets feeding.

Furthermore, the sorter 6 can write various information to the RFID tag 11*a* of the target object 10 by use of the multiple sheets feeding detection apparatus 1*a*, which leads to an increase in the management level of the target objects 10.

Note here that, the sorter 6 of this embodiment is so configured that target objects 103 are sorted to gathering units 110 by way of carrier boxes 120 which travel along the circular route formed into an endless loop, but is not limited to this configuration. For example, the sorter 6 may be configured so as not to use the carrier boxes 120 traveling along the circular route formed into an endless loop.

The multiple sheets feeding detection apparatus, the sorter, and the method of detecting multiple sheets feeding according to the present invention have been described in connection with the preferred embodiment. It should, however, be understood that the multiple sheets feeding detection apparatus, the sorter, and the method of detecting multiple sheets feeding according to the present invention are not limited to the foregoing embodiment, and various modifications or changes may be made without departing from the spirit of the present invention.

For example, the passage detector 2 and the management code detector 3 are spaced apart from each other in the multiple sheets feeding detection apparatus, and when two or more target objects 10 are being carried therebetween, the controller 4 controls the management code detector 3 and removal portion 5 by allocating provisional numbers to those target objects 10, so that the function of the above-mentioned multiple sheets feeding detection apparatus 1 can be fully utilized.

The multiple sheets feeding detection apparatus according to the present invention is an apparatus for detecting multiple sheets feeding of target objects, and when removal portion is added to this apparatus, a multiple sheets feeding detection apparatus with the removal portion is provided. Furthermore, by reading management code information, a management code reading apparatus having a multiple feeding detecting function is provided which is also preferably utilizable.

The method of detecting multiple sheets feeding according to the present invention is a method for detecting multiple sheets feeding of target objects, and when a removal step is added to this method, a method of detecting multiple sheets feeding including the removal step is provided. Furthermore, when management code information is read, a management code reading method having a multiple feeding detecting function is provided which is also preferably utilizable.

What is claimed is:

1. A multiple sheets feeding detection apparatus comprising:

a passage detector that detects passage of a target object and outputs passage information, the target object being carried by carrier means and having an RFID tag attached thereto;

a management code detector that receives management code information wirelessly sent from the RFID tag and outputs the management code information; and a controller that receives inputs of the passage information and the management code information, determines a carrier state of the target object in accordance with the passage information and the management code information, and outputs a multiple feed generation signal when multiple sheets feeding occurs.

2. The multiple sheets feeding detection apparatus according to claim 1, further comprising:

removal means for removing the target object from the carrier means upon receipt of the multiple feed signal.

3. The multiple sheets feeding detection apparatus according to claim 1, wherein the target object is a paper sheet.

4. The multiple sheets feeding detection apparatus according to claim 1, wherein the RFID tag is attached indirectly to the target object.

5. The multiple sheets feeding detection apparatus according to claim 1, wherein the controller sends and writes predetermined information corresponding to the carrier state of the target object to the RFID tag by way of the management code detector.

6. A sorter sorting target object to be sorted, comprising:

a feeder that feeds the target objects;

a drop unit that drops the target objects;

carrier means for carrying the target objects from the feeder to the drop unit; and the multiple sheets feeding detection apparatus of claim 1, the multiple sheets feeding detection apparatus being disposed along the carrier means.

7. A method of detecting multiple sheets feeding, comprising:

a passage detecting step of detecting passage of a target object and outputting passage information, the target object being carried by carrier means and having an RFID tag attached thereto;

a management code detecting step of receiving management code information wirelessly sent from the RFID tag and outputting the management code information; and a controlling step of receiving inputs of the passage information and the management code information, determining a carrier state of the target object in accordance with the passage information and the management code information, and outputting a multiple feed signal when multiple sheets feeding occurs.

8. The method of detecting multiple sheets feeding according to claim 7, further comprising:

a removing step of removing the target object from the carrier means upon receipt of the multiple feed signal.

9. The method of detecting multiple sheets feeding according to claim 7, wherein the target object is a paper sheet.

10. The method of detecting multiple sheets feeding according to claim 7, wherein the RFID tag is attached indirectly to the target object.

11. The method of detecting multiple sheets feeding according to claim 7, wherein the controlling step includes sending and writing predetermined information corresponding to the carrier state of the target object to the RFID tag through the management code detecting step.

* * * * *